United States Patent [19]

Kelly et al.

[11] Patent Number: 4,993,623

[45] Date of Patent: Feb. 19, 1991

[54] PRODUCE CONTAINER OR THE LIKE

[75] Inventors: Peter C. Kelly, Neenah; Donald E. McGillan, Milwaukee; Russell L. Johnson, Weyauwega; Edward M. Kaucic, Watertown; Richard R. Masten, Jr., Neenah, all of Wis.

[73] Assignee: Menasha Corporation, Neenah, Wis.

[21] Appl. No.: 410,438

[22] Filed: Sep. 21, 1989

[51] Int. Cl.[5] ..... B65D 6/00

[52] U.S. Cl. ..... 229/23 R; 229/110; 220/5 R

[58] Field of Search ..... 229/23 R, 110, 130; 220/4 F, 283, 306, 4 D, 4 E

[56] References Cited

U.S. PATENT DOCUMENTS

| | | | |
|---|---|---|---|
| 2,872,031 | 3/1959 | Lindberg | 206/45.34 |
| 3,077,281 | 2/1963 | Brauerman | 220/4 E |
| 3,373,921 | 3/1968 | Crane | 229/23 R |
| 3,487,991 | 1/1970 | Stern | 229/23 |
| 3,915,372 | 10/1975 | Crane | 229/23 R |
| 3,935,990 | 2/1976 | Crane | 229/34 R |
| 3,941,300 | 3/1976 | Troth | 229/5.5 |
| 3,958,747 | 5/1976 | Chipp et al. | 229/43 |
| 4,019,674 | 4/1977 | Ikelheimer et al. | 229/23 R |
| 4,068,794 | 1/1978 | Lawrence | 229/23 R |
| 4,175,691 | 11/1979 | Cornell et al. | 229/23 R |
| 4,230,233 | 10/1980 | Orr | 217/36 |
| 4,482,074 | 11/1984 | Lalley | 220/4 F |
| 4,637,544 | 1/1987 | Quercetti | 229/44 R |

FOREIGN PATENT DOCUMENTS

| | | | |
|---|---|---|---|
| 1057959 | 2/1967 | United Kingdom | 220/306 |

*Primary Examiner*—Gary E. Elkins

*Attorney, Agent, or Firm*—Quarles & Brady

[57] ABSTRACT

A container composed of semiflexible body and two semiflexible end caps wherein the body and the end portions fit together in a rigid manner to provide a rigid container. Although a firm latching between the body and the end caps is afforded, they can be disassembled if desired. In a preferred manner, the end caps are composed of a semiflexible plastic material, and the semiflexible body is composed of fiberboard. The container is durable so that several of the units can be stacked upon each other. It also offers versatility in that the fiberboard body can be divided with different panel portions so as to afford a display type container.

21 Claims, 6 Drawing Sheets

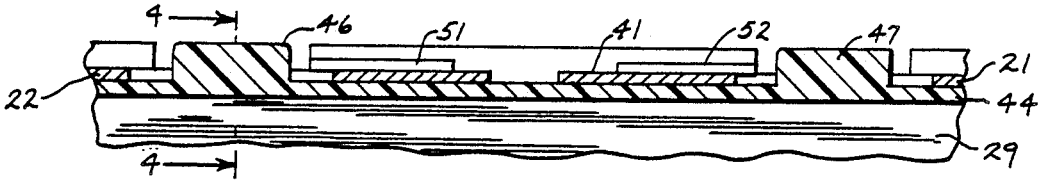
FIG. 3
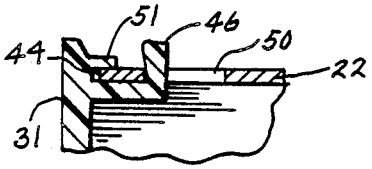
FIG. 4
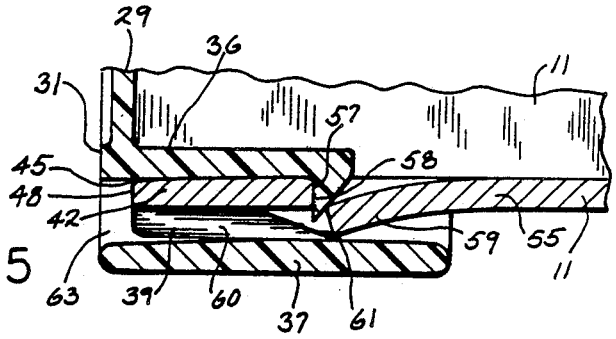
FIG. 5
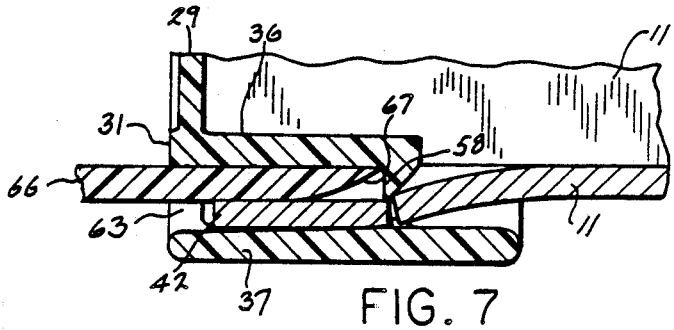
FIG. 7
FIG. 9
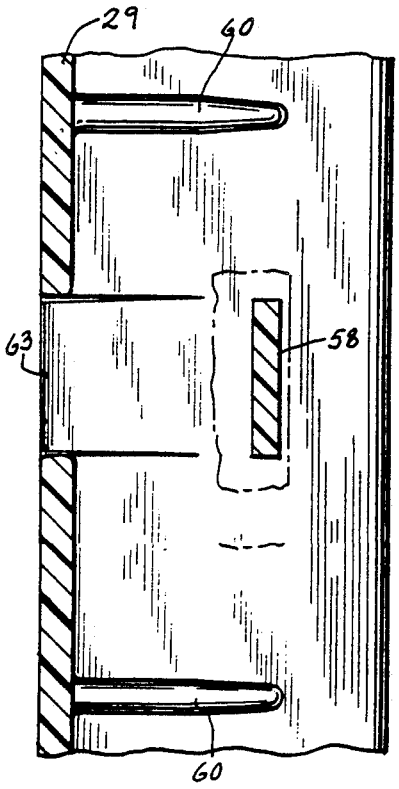
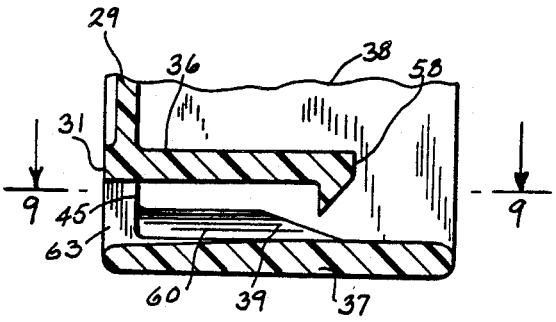
FIG 8

PRODUCE CONTAINER OR THE LIKE

BACKGROUND OF THE INVENTION

The invention relates to a container for shipping and displaying produce or the like. More particularly, the invention relates to a container which is composed of separate end pieces and a one piece body wherein both the end pieces and the body are formed from semiflexible materials with the body formed from fiberboard or paperboard. The end pieces and the body are held in a rigid manner between the end pieces yet the body can be removed from the end pieces after useage.

Containers which utilize rigid or flexible end pieces for holding cardboard or similar type of body members are well known. For example, these are shown in the following U. S. Pat. Nos.: 3,915,372; 3,935,990; 3,958,747; 4,019,674; 4,482,074; and 4,637,544. These patents show various arrangements for fastening the container body to the end pieces. For example, in U. S. Pat. No. 3,958,747 this is accomplished in part by the terminal flange portions 20 or 72 and the frame member 40. In U. S. Pat. No. 4,019,674 a fiberboard body is inserted in a tight manner into U-shaped slots of the end cap members. In U. S. Pat. No. 4,482,074 a key lock arrangement is employed between a cardboard body and the end pieces, while in U. S. Pat. No. 4,637,544 a cardboard body of the open end type is designed for fitting into U-shaped grooves of the end pieces. In this particular patent there is also shown a projection 20 for holding a cut edge of the fiberboard body against a tooth in the U-shaped channels.

The prior art does not provide a container wherein a semiflexible body is retained by two semiflexible end cap members in a manner such that rigidity is imparted to the semiflexible body section through its capture in the end cap members. In some instances, the prior art is concerned with the use of an adhesive to secure the fiberboard body which does not allow for removal from the end pieces. Accordingly the prior art does not provide a rigid container system which can be easily taken apart for recycling purposes. In other instances where a mechanical type connection is indicated between the body and the end pieces, the attachment is not a tight fitment. This allows for movement with respect to the body in the end cap members and a container system which is not rigid.

It is an advantage of the present invention to provide a rigid container system from semiflexible components.

It is another advantage of the present invention to provide a container having a body section and two semiflexible end cap members wherein the components are locked together in a rigid manner.

It is yet another advantage of the invention to provide a container of the foregoing type which is locked in a rigid manner by a mechanical locking means and can be disassembled with the use of a tool.

It is still another advantage of this invention to provide a container of the foregoing type which provides for maximum container capacity.

It is yet another advantage of the invention to provide a container of the foregoing type wherein the cover portion can be opened for display purposes yet without destruction of the container.

Other advantages of this invention are a container of the foregoing type which can be manufactured at low cost and from readily available material and can be easily assembled.

SUMMARY OF THE INVENTION

The foregoing advantages are accomplished and the shortcomings of the prior art are overcome by the present container which includes a body having two parallel cap engaging edges and two parallel free edges at right angles to the cap engaging edges. The body is provided with at least two fold lines parallel to the free edges, and is foldable along the fold lines to form an open ended container wherein the cap engaging edges lie in parallel planes which are perpendicular to the fold lines. Two end caps are engageable with the folded body so as to close the open ends of the container. The cap engaging edges of the body are mechanically engaged with the end caps by means operatively associated with cap engaging edge portions and the end caps to maintain the engaging edges of the body in contact with the end caps so as to impart a high degree of stiffness to the assembled container.

In one embodiment, the body and the end caps are semiflexible with the end caps being end pieces providing channels for the limited insertion of lateral edges of panel portions forming the flexible body. Catch surfaces are disposed in the end pieces to engage edge surfaces of cut out portions in the panel portions when the lateral edges of the panel portions are inserted therein.

In a preferred manner, the end caps have end walls positioned at the outermost portions of the end caps and opposite to the semiflexible body to provide a maximum capacity for the container when assembled.

Also in a preferred manner, there are access openings through the end caps to afford a tool to be inserted therethrough for release of the cap engaging edges from the end caps, and the channels are defined by opposing wall surfaces with one of the wall surfaces positioned opposite the catch surfaces extending outwardly to provide a guide surface for insertion of the semiflexible body.

In a preferred embodiment, the inner wall surfaces of the end caps are constructed with an undulating surface.

In an alternative embodiment, the semiflexible body has two foldable panels providing a cover. The panels can be moved from a covering position to a display position at the side of the container.

BRIEF DESCRIPTION OF THE DRAWINGS

A better understanding of the present container will be accomplished by reference to the drawings wherein:

FIG. 3 is a view in vertical section taken along line 3—3 of FIG. 1.

FIG. 4 is a view in vertical section taken along line 4—4 of FIG. 3.

FIG. 5 is a view in vertical section taken along line 5—5 of FIG. 1.

FIG. 7 is a view similar to FIG. 5 showing the tool in operative engagement with the container.

FIG. 8 is a view similar to FIG. 5 with the container body removed therefrom.

FIG. 9 is a view in horizontal section taken along line 9—9 of FIG. 8.

DESCRIPTION OF THE PREFERRED EMBODIMENTS

Figure 1:
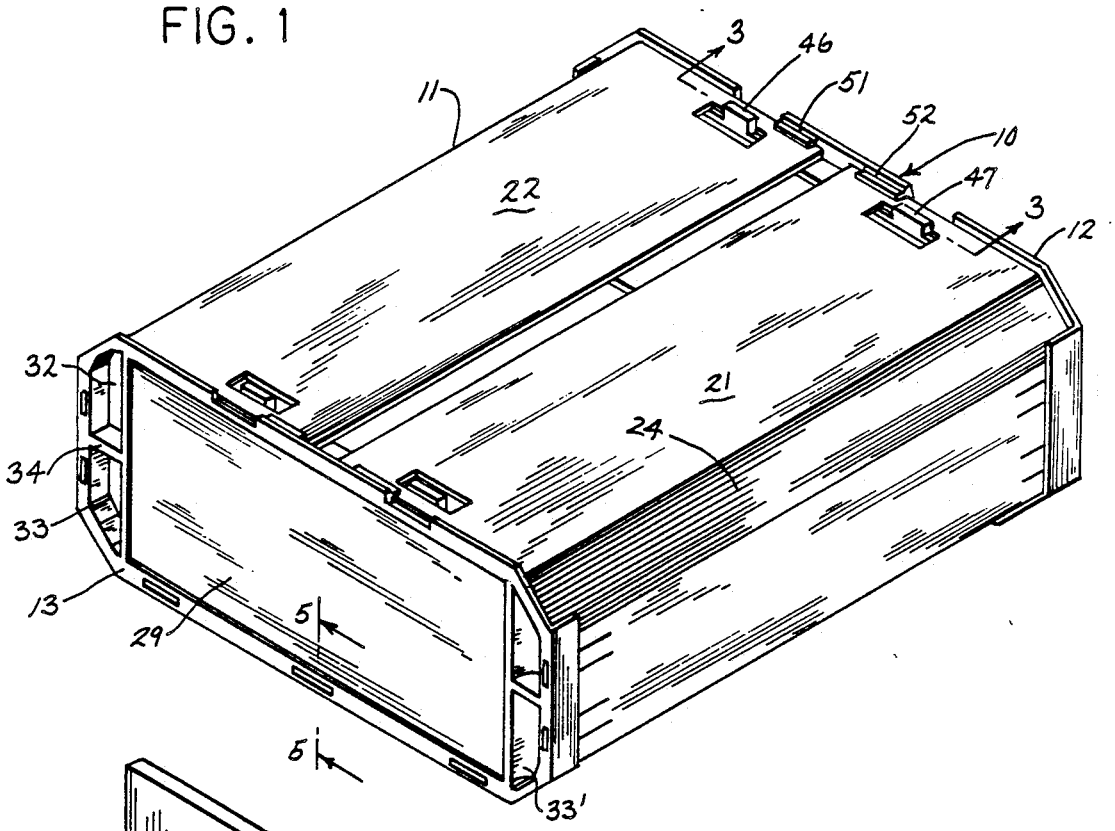
FIG. 1 is a top perspective view showing the container of this invention in an assembled condition.
Figure 2:
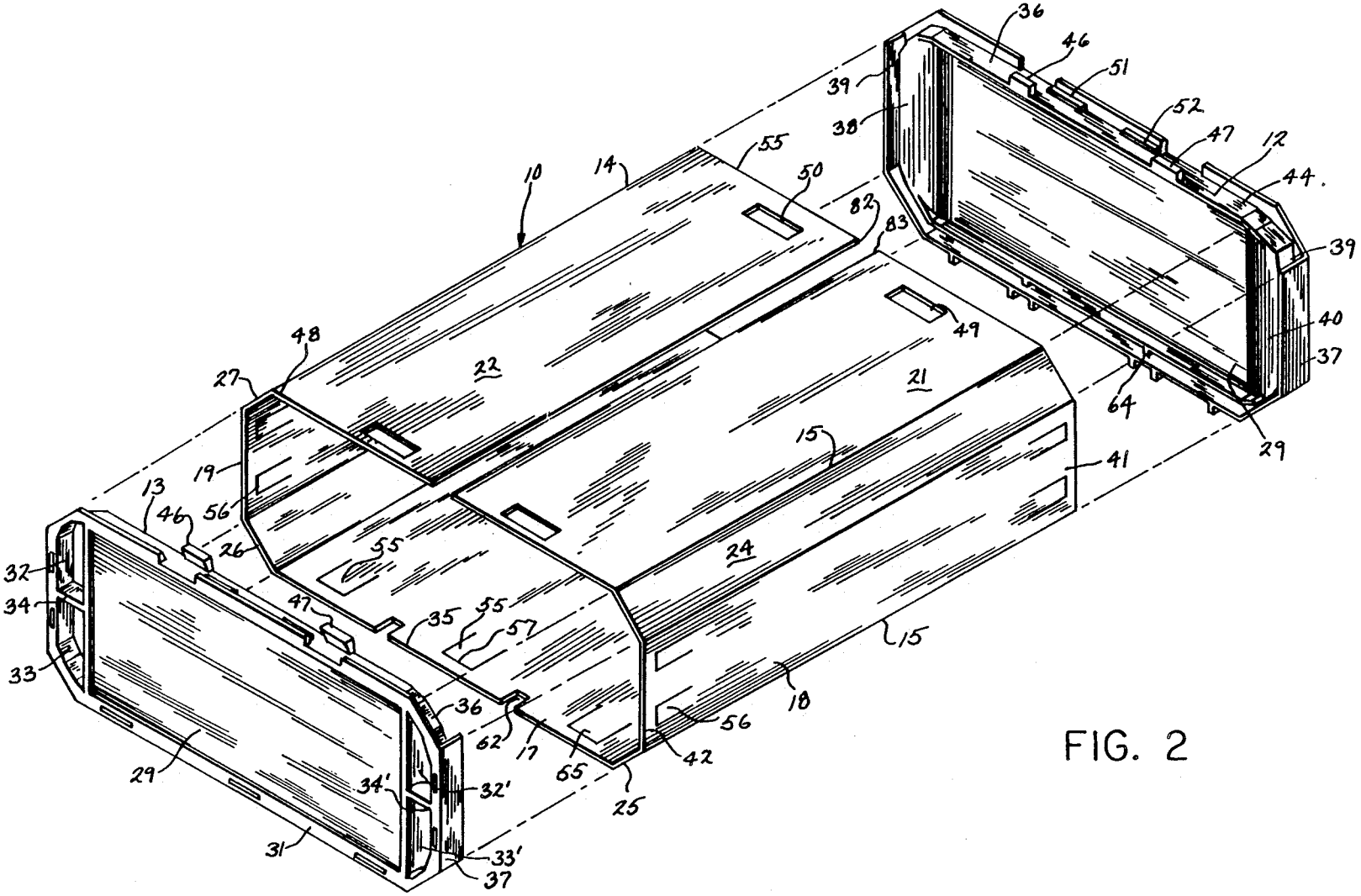
FIG. 2 is an assembly view in perspective of the container shown in FIG. 1.

Proceeding to a detailed description of the present invention, and in particular FIGS. 1 and 2, the container generally 10 is basically a three piece construction. It is composed preferably of a semiflexible fiberboard body 11 and two flexible end caps 12 and 13 preferably molded of a high density polyethylene resin material. The semiflexible fiber board body 11 is in the form of a container blank 14 with a multiplicity of parallel score or fold lines 15. The fold lines define a bottom panel 17, side panels 18 and 19, top panels 21 and 22, and intermediate panels 24, 25, 26 and 27.

The end caps 12 and 13 are exactly the same, and consequently what is described for one pertains to the other. Each has an end wall panel 29 surrounded by a frame portion 31. Pockets 32, 32' and 33, 33' are positioned laterally of the panels and are separated by the reinforcing ribs 34 and 34'. These ribs are innerconnected with a peripheral wall 36. As best seen in conjunction with end cap 12 in FIG. 2, curved wall portions 38 and 40 extend from the peripheral wall 36 and outwardly toward the end wall panel 29. A flange portion 37 is spaced from peripheral wall 36 at the sides and bottom thereof to provide a channel 39. It will be seen that the top portion 44 of the peripheral wall 36 does not have the flange portion 37 surrounding it. There are, however, guide members 46 and 47 extending upwardly therefrom and the laterally extending latch members 51 and 52 the purpose of which will be next explained.

The semiflexible body 11 is constructed so that the lateral edge portions 41 and 42 of all of the panels except top panels 21 and 22 will fit in the channels 39 of the end caps 12 and 13. In this position, the lateral edge portions of the top panels 21 and 22 will overlie the top portion 44 of the end caps. The openings 49 and 50 are arranged to be guided by the guide members 46 and 47 so that edge portions 41 and 42 are latched under latch members 51 and 52. This is best seen in FIGS. 3 and 4. The latch members 51 and 52 provide retention of the top panels 21 and 22 as well as a release thereof.

FIGS. 5, 7, 8 and 9 show the particular catch means for firmly holding the semiflexible body 11 in the end caps 12 and 13. It will be seen in FIG. 2 that the semiflexible body 11 has the cut out portions or tab members 55 in the bottom panel 17 and in the side panels 18 and 19 such as shown at 56. As best seen in FIG. 5, the lateral edge portion 42 of the semiflexible body 11 is trapped between the end wall 29 and the ramped tooth 58 with the cut edge surface 57 engaging the tooth 58. This separation of the edge portion 42 from the rest of the body 11 is effected by the cut edge surface 57 when the cut out portion 55 is positioned under tooth 58. The cut out portion 55 will assume a slightly bent configuration in the area of the tooth 58. This is indicated at 59. It should be pointed out that in order to place the lateral edge portion 42 in the end cap 13, it needs to be inserted into the cap channel 39 a distance greater than the distance between the edge surface 48 and the tooth engaging edge surface 57. This allows the separated tab edge portion 42 to be deflected out of the plane of the body 11 and is afforded by the radiused surface 45 of the end wall 29 which in this instance is 0.060 inch. The lateral edge portion 42 is held against the peripheral wall 36 by the projection 60 which is displaced from the plane of the tooth 58 and extends upwardly from the flange 37. A snug holding is effected by spacing the projections 60 from the wall 36 a distance approximately equal to the thickness of body 11 which restricts movement of the body 11 in a direction transverse to the cap engaging edge 42 of the panel 17 and in conjunction with tooth 58 restricts movement axial to the longitudinal axis of the body 11. This is depicted in FIGS. 5 and 9. The orientation of the edge surfaces 57 with the tooth 58 is assisted by the surfaces of the U-shaped slots 62 engaging with the projections 64 which are also disposed in the guide channel 39. This is best seen in FIG. 2. The interengagement between the slots 62 and the projections 64 also prevents movement parallel to the cap engaging edge 35 of the panel 17 or transverse to the longitudinal axis of the body 11.

The particular attachment of the lateral edge portion 42 in the channel 39 is important even though cut out type latching in this art is common. In this instance it should be particularly noted that lateral edge portion 42 provides a locking strip which is securely held against the peripheral wall 36 by the projection 60, and that the cut edge surface 57 and the opposing edge surface 48 of the lateral edge portion 42 are snugly fitted between the radiused surface 45 and the tooth 58. Note also the overlap of the tooth 58 with respect to the width of the edge portion 42.

Figure 6:
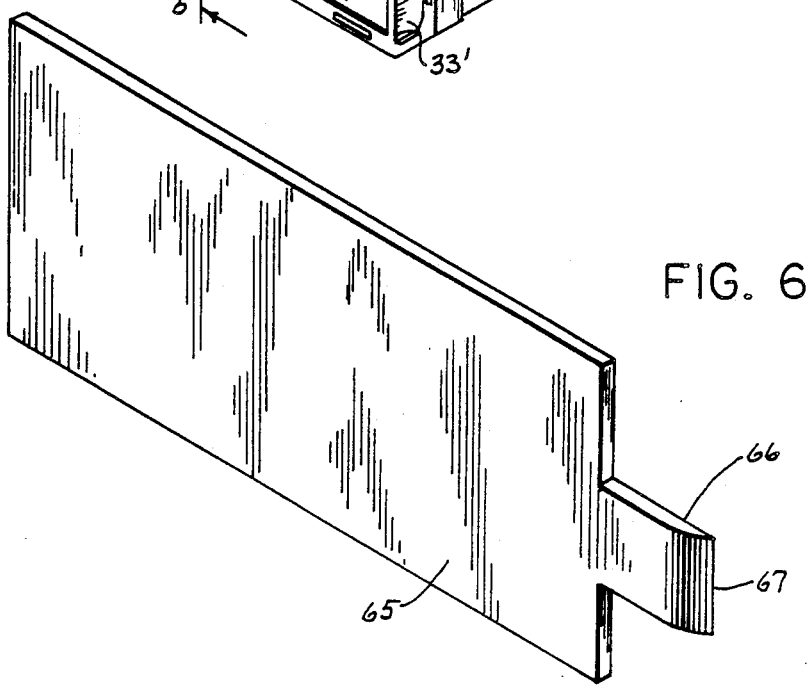
FIG. 6 is an enlarged perspective view showing a tool for use in conjunction with the container of this invention.

Another important feature of this invention is the fact that should it be desired to release the fiberboard body 11 from the end caps 12 and 13, there is provided the opening 63 through the frame portion 31 and in alignment with the tooth 58. This allows for displacement of the lateral edge portion 42 by the tool 65 shown in FIG. 6. The beveled edge 67 of the tongue 66 is inserted between the lateral edge portion 42 and the peripheral wall 36 so as to displace the lateral edge 42 portion away from the peripheral wall 36 and under the tooth 58. This is best seen in FIG. 7. In this position, the semiflexible body 11 can be removed from the end caps 12 and 13. The opening 63 is conveniently formed during the molding of the end caps.

Figure 14:
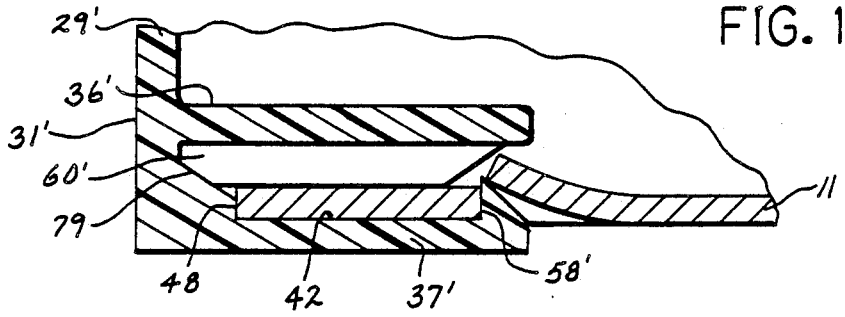
FIG. 14 is a view similar to FIG. 5 illustrating an alternative catch means for the container body in the end panel.

In some of the Figures of the drawings which will be subsequently referred to herein, similar components are referred to as described in conjunction with the previous Figures embodiments except they are "primed" or "double primed." Referring to FIG. 14 there is shown an alternative catch means for the lateral edge portion 42. It will be seen that there is a beveled wall 79 extending from end wall 29' with wall 79 engaging edge surface 48 to snuggly hold the lateral edge portion 42 between it and the tooth 58'. Note that the positions of the tooth 58, and the projection 60' are reversed. While no opening is shown through the frame portion 31' for insertion of the tool 65, this could be provided if desired.

Figure 10:
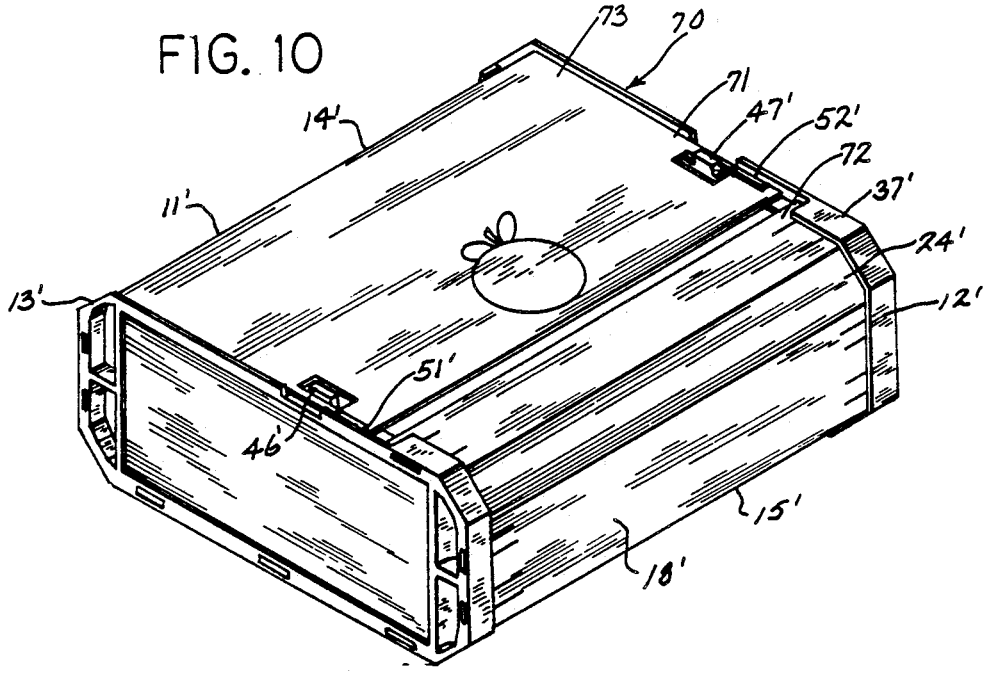
FIG. 10 is a top perspective view of an alternative embodiment of the container of this invention.
Figure 11:
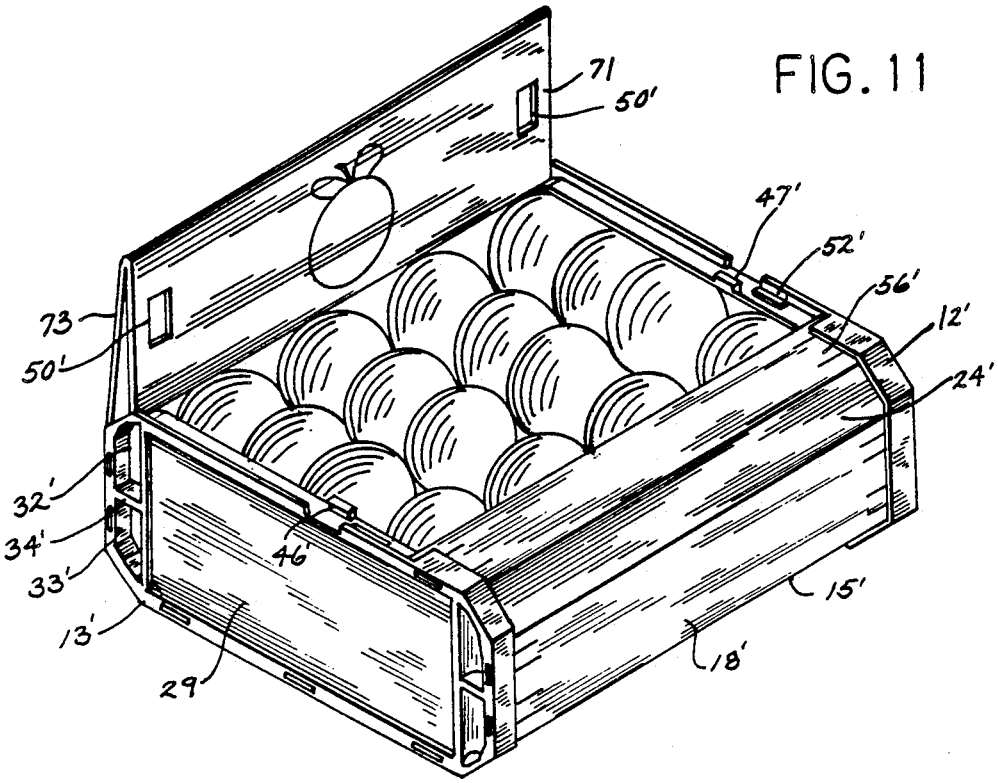
FIG. 11 is a view similar to FIG. 10 showing the alternative embodiment in a display mode.

FIGS. 10 and 11 illustrate an alternative embodiment generally 70 which will utilize similar end caps 12' and 13' as previously indicated for embodiment 10. Instead of two top panels such as 21 and 22 in embodiment 10, there are provided three panels 71, 72 and 73. In this instance, the panels 71 and 73 are the same size, with panel 71 being secured to the end caps 12' and 13' by the latch members 51' and 52'. When it is desired to utilize this container for display purposes, the panel 71 would be unlatched from the latch members 51' and 52' with the top panel 71 being folded upwardly as well as the panel 73 to a position shown in FIG. 11. The attachment between the semiflexible body 11' and the end caps 12' and 13' is the same as depicted in FIG. 5 for embodiment 10. Note also the attachment of the panel 72 to the end caps 12' and 13' as indicated by the cut out portions 56' and the extension of the flange portion 37' to provide a channel such as 39 and the previously described catch means in the top of the container.

Figure 12:
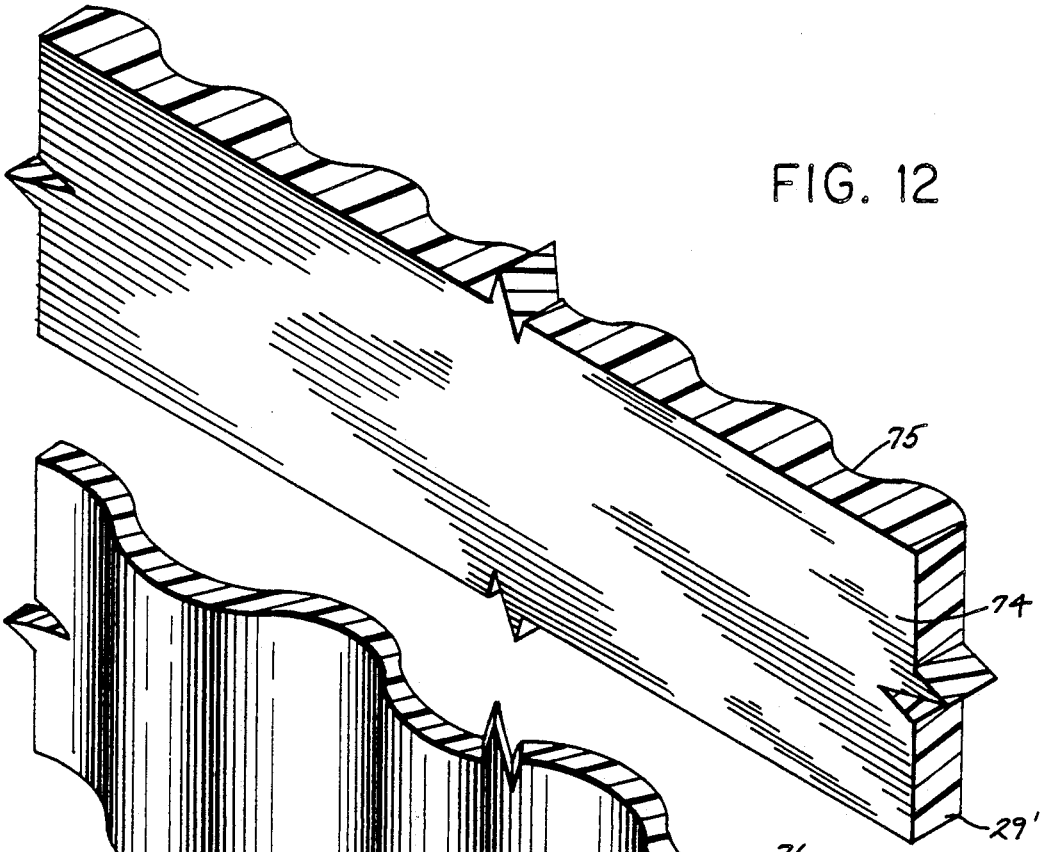
FIG. 12 is a partial view of a preferred end panel for use in the container of this invention.
Figure 13:
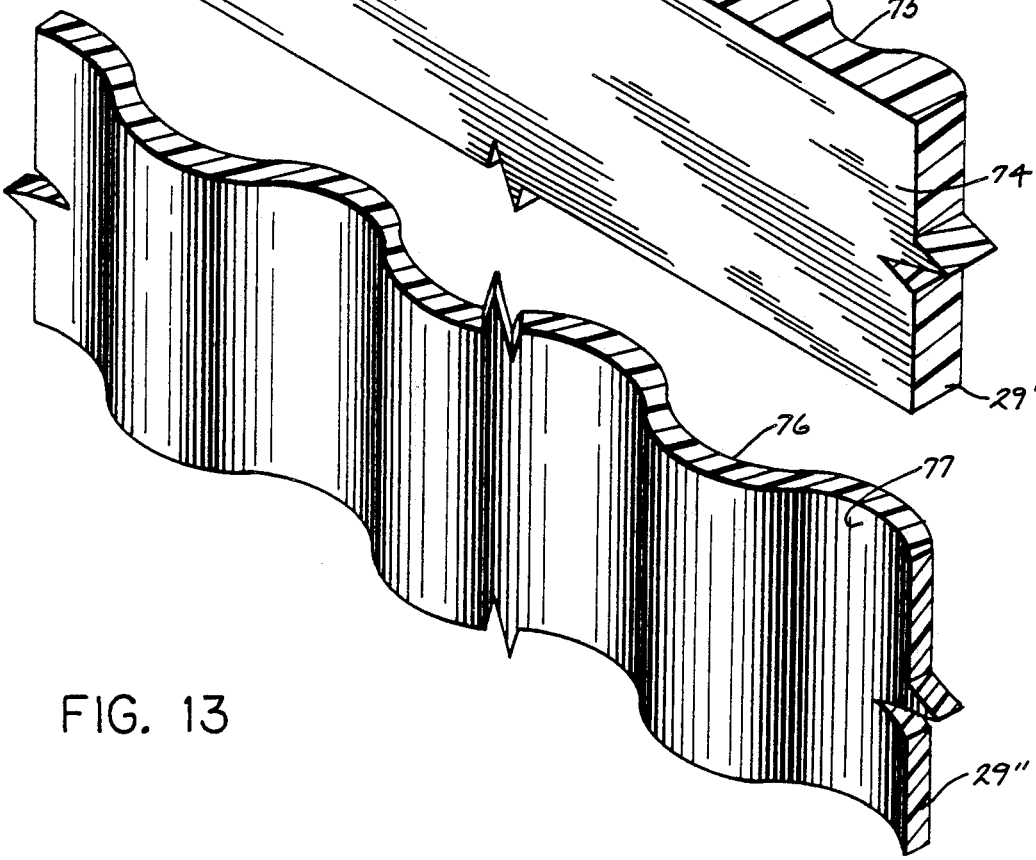
FIG. 13 is a view similar to FIG. 12 showing another wall construction for an end panel.

FIGS. 12 and 13 illustrate alternative end walls for the end wall 29 shown in conjunction with the end caps 12 and 13. In the instance of end wall 29', it has a plain surface side 74 and an opposing undulating surface 75. This is the preferred end wall configuration. In compression testing it was found that a panel with this wall could withstand a compression force of 2100 lbs. It should also be pointed out that the same panel without the wall 29 and just the frame 31 could withstand a force of 1800 lbs. This wall embodiment is also preferred because it presents a flat surface for printing. With respect to end wall 29" it has two opposing undulating walls as represented by the numerals 76 and 77. Both end walls 29' and 29" could be used in either embodiment 10 or 70 in the end caps 12 and 13 which are shown with two opposing smooth wall surfaces. The undulating surfaces offer the advantage increased strength for a given wall thickness. The dual undulating surfaces 76 and 77 offer twice the advantage in this respect. A disadvantage of the dual undulating surface is that it does not provide a surface that lends itself to easy printing for information purposes.

The term "semiflexible" as used herein means an end cap such as 12 or a fiberboard body wherein the ends can be distorted out of a plane readily. The term "rigid" as used herein means that these components cannot be distorted out of a plane readily. As stated earlier, an important aspect of this invention is the snug fitting of the edge portions 41 and 42 in the catch means as represented by the radiused wall 45 and the tooth 58 as well as the distance between the projection 60 and the peripheral wall 36. It should also be considered that the end caps 12 and 13 are semiflexible as is the fiberboard body 11. It is unexpected that when these components are fitted together, that a rigid container results. This is afforded by the catch means and the geometric relationship between the end caps 12 and 13 and the body 11. The body 11 has two parallel cap engaging edges 48 and 55 and two parallel free edges at 82 and 83 at right angles to the cap engaging edges. This is best seen in FIG. 2. The body 11 is provided with at least two fold lines 15 parallel to the free edges 82 and 83. The body is foldable along the fold lines to form an open ended container wherein the cap engaging edges 48 and 55 lie in parallel planes which are perpendicular to the fold lines. The two end caps 12 and 13 are engageable with the folded body 11 so as to close the open ends of the container. The cap engaging edges 48 and 55 when mechanically engaged with the end caps 12 and 13 and the catch means, maintains the body 11 in tight fitting contact with the end caps 12 and 13 so as to impart a high degree of stiffness to the assembled container.

Figure 15:
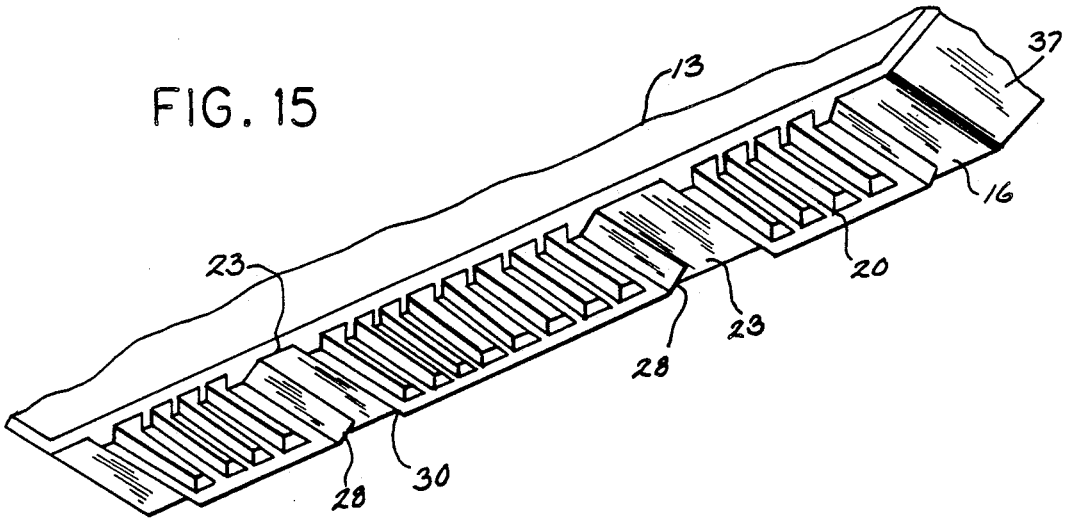
FIG. 15 is a bottom perspective view of one of the end panels.
Figure 16:
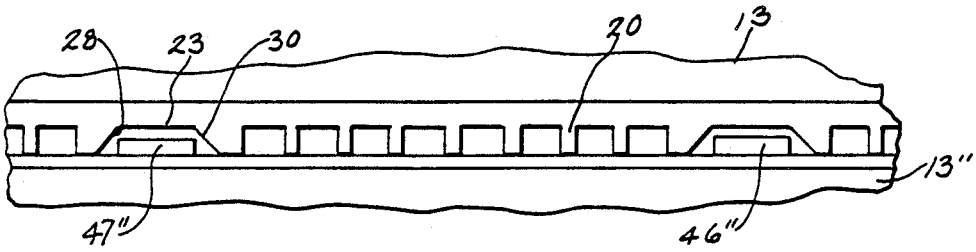
FIG. 16 is a partial view illustrating the stacking of two of the end panels.

Referring to FIGS. 15 and 16, a stacking feature for the container 10 is illustrated. End cap 13 has a bottom surface 16 from which extend the ribs 20 interrupted by the passages 23. Each passage 23 has opposing and angular walls 28 and 30 defining an opening 68 receiving the guide members 46" and 47" of another end cap 13' which would be placed beneath it during a typical stacking of one or more containers 10.

Referring back to FIGS. 5, 7 and 8, it will be seen that flange portion 37 extends horizontally beyond the peripheral wall 36. This serves as a guide surface for the body 11 when the cap engaging edge portion 42 is inserted into the channel 39 of the panels 12 and 13.

In the foregoing description, a tool 65 has been shown for use in conjunction with the opening 63 for removing the semiflexible body 11 or 11' from the respective end caps 12 and 13. While this is an important feature, it will be appreciated that the latching between the fiberboard bodies 11 and 11' and the end caps 12 and 13 can be effected without it and still obtain a rigid container structure.

While the latch members 51 and 52 have been shown to have a rectangular configurations for temporarily holding the top panels of the fiberboard bodies to the end caps 12 and 13, these can be of various geometric designs provided they effect the function of a frictional and temporary holding the cover panels 21 and 22 onto the end caps. Further, certain guide slots 62 have been indicated for orientation with respect to the projections 64 for purpose of aligning the cut out portions 55 and 56 with the teeth 58. These also could be eliminated. The horizontal extension of the flange portion 37 with respect to the peripheral wall 36, also affords an alignment feature for the body 11 during the previously described latching. This also could be obviated. It should also be pointed out that the smooth and curved walls 38 and 40 offer a surface which will not readily damage the contents of the container such as fruit. While this is advantageous, it can be of any geometric design provided it lends support between walls 36 and 29.

Fiberboard such as that provided by the Menasha Corp of Neenah WI is a preferred sheet material for forming the semiflexible body of the container of this invention. However, many other sheet materials which have sufficient strength and can be scored, die cut, and folded to form a useful body for the container of this invention can be employed. These could include corrugate, cardboard, light gauge sheet metal, as well as thermoplastic, and thermosetting plastic, sheet material.

In many states, laws regarding the recyclability of containers are being proposed. An "irreversible mechanical engagement" such as that described in U.S. pat. No. 4,637,544 or an "adhesively secured" cap and body such as that described in U.S. Pat. No. 4,019,674, will not conform to most of these proposed laws. The present invention, however, provides the means for separating the plastic elements of the container described herein from the fiberboard elements so that either or both of them can be reused and/or recycled.

It will thus be seen that through the present invention there is now provided a container which can be fabricated from semiflexible components yet provides a very sturdy structure for fruit or the like and can be stacked with several other containers of the same construction. The container employs a minimum number of parts and is easily assembled. Further, it offers the advantage of disassembly if this is desired to recycle the components. The container is versatile in that it can accept different body portions so as to provide a display mode. In addition, by placing the end walls 29 of the end caps 12 and 13 at the outermost portions of the end caps an increase in capacity of 75% for the volume of the end cap can be realized.

We claim:

1. A container comprising:

a body having two parallel cap engaging edges and two parallel free edges at right angles to said engaging edges, said body provided with at least two fold lines parallel to said free edges, said body being foldable along said fold lines to form an open ended container wherein said cap engaging edges lie in parallel planes which are perpendicular to said fold lines; and two end caps engageable with said folded body so as to close open ends of said open ended container and said cap engaging edges of said body being mechanically engaged with said end caps by releasable locking means operatively associated with cap engaging edge portions and said end caps to maintain edges of said body in contact with said end caps so as to impart a high degree of stiffness to said container when assembled, said releasable locking means including locking strips that abut against both a catch tooth and an opposing wall.

2. A container formed from a body and two end pieces comprising:

said body defined by a sheet with score lines to provide wall panel portions;

cut out portions including edge surfaces located near lateral edges of said panel portions;

said end pieces providing channels for the limited insertion of said lateral edges of said panel portions therein;

catch surfaces defined by said end pieces to engage said edge surfaces of said cut out portions when said lateral edges of said panel portions are inserted therein; and an opening extending through a wall of each said end piece and positioned opposite said catch surface to permit a tool to be inserted therethrough so as to engage said cut out portions for removal from said catch surfaces.

3. The invention as defined in claim 2 wherein said channels are defined by opposing wall surfaces and an additional wall surface positioned opposite said catch surfaces, one of said opposing wall surfaces extending outwardly therefrom to provide a guide surface for said sheet body.

4. The invention as defined in claim 3 wherein said catch surfaces are defined by ramp surfaces inclined toward said additional opposing wall of said channel.

5. The invention as defined in claim 2 wherein said end pieces are formed from a semiflexible resinous plastic material and said opening extending through said wall of said end piece is formed during the molding of said end piece.

6. The invention as defined in claim 2 wherein said end pieces further include latch members for engagement with cover panel portions of said sheet body for temporary retention thereof.

7. The invention as defined in claim 6 wherein said sheet body further includes cut out portions and said end pieces include guide members for placement therein to guide said cover panel portions into said latch members.

8. The invention as defined in claim 2 wherein said catch surfaces are defined by tab members cut out from said sheet body with said tab members remaining in contact with said sheet body.

9. The invention as defined in claim 2 wherein said sheet body is formed from fiberboard and said end pieces are dimensioned to provide a container for fruit.

10. A container formed from a sheet body and two supporting end pieces comprising:

said sheet body defined by score lines to provide wall panel portions;

cut out portions defining locking strips including edge surfaces located near lateral edges of said panel portions;

end pieces providing channels for the limited insertion of said lateral edges of said panel portions therein; and catch means positioned in said channels and including projections and a first opposite wall disposed in said channels, a catch tooth and a second wall positioned opposite from said catch tooth, and said projections spaced apart to allow insertion of said locking strips between said catch tooth and said projections, with said first wall, said projections, said catch tooth and said second wall constructed and arranged to secure said locking strips in said channels in a manner such that the locking strips abut against both said catch tooth and said second wall so as to prevent movement of said locking strips in both an axial and transverse manner in said channels while allowing subsequent release of said locking strips.

11. The invention as defined in claim 10 wherein said projections are in a plane spaced from said catch tooth.

12. The invention as defined in claim 10 wherein said second wall is defined by an end wall of said end pieces.

13. The invention as defined in claim 10 wherein said second wall is defined by a radiused wall.

14. The invention as defined in claim 10 wherein said second wall is defined by a beveled wall.

15. The invention as defined in claim 10 wherein said end pieces have opposing wall surfaces which are in a single plane.

16. The invention as defined in claim 10 wherein said end pieces have opposing wall surfaces, one of which is in a single plane and the opposing one has a continuous undulating surface.

17. The invention as defined in claim 10 wherein said end pieces have opposing wall surfaces both of which have a continuous undulating surface.

18. The invention as defined in claim 10 wherein said sheet body is formed from fiberboard and including latch and guide means extending from a top portion of said end pieces for engagement with a cover panel portion of said sheet body, said end pieces including at least one passage on a bottom thereof for receiving said guide means of another end piece when they are stacked on one another.

19. The invention as defined in claim 10 including guide means operatively associated with said sheet body and said end pieces for orientating said cut out portions with said catch means.

20. A container comprising:

a body having two parallel cap engaging edges and two parallel free edges at right angles to said engaging edges, said body provided with at least two fold lines parallel to said free edges, said body being foldable along said fold lines to form an open ended container wherein said cap engaging edges lie in parallel planes which are perpendicular to said fold lines; and two end caps engageable with said folded body so as to close open ends of said open ended container and said cap engaging edges of said body being mechanically engaged with said end caps by means operatively associated with cap engaging edge portions and said end caps to maintain edges of said body in contact with said end caps so as to impart a high degree of stiffness to said container when assembled, said end caps having end walls positioned at outermost portions of said end caps and opposite to each other to provide a maximum capacity for said container when assembled.

21. A container comprising:

a body having two parallel cap engaging edges and two parallel free edges at right angles to said engaging edges, said body provided with at least two fold lines parallel to said free edges, said body being foldable along said fold lines to form an open ended container wherein said cap engaging edges lie in parallel planes which are perpendicular to said fold lines; and two end caps engageable with said folded body so as to close open ends of said open ended container and said cap engaging edges of said body being mechanically engaged with said end caps by means operatively associated with cap engaging edge portions and said end caps to maintain edges of said body in contact with said end caps so as to impart a high degree of stiffness to said container when assembled, said end caps including access openings to afford a tool to be inserted therethrough for release of said cap engaging edges from said end caps.

* * * * *